US009382862B2

(12) United States Patent
Chen et al.

(10) Patent No.: US 9,382,862 B2
(45) Date of Patent: Jul. 5, 2016

(54) AIR-FUEL PARAMETER CONTROL SYSTEM, METHOD AND CONTROLLER FOR COMPENSATING FUEL FILM DYNAMICS

(71) Applicant: NATIONAL TAIPEI UNIVERSITY of TECHNOLOGY, Taipei (TW)

(72) Inventors: Bo-Chiuan Chen, Taipei (TW); Yuh-Yih Wu, Taipei (TW); Wen-Han Tsai, Taoyuan County (TW); Hsien-Chi Tsai, Kaohsiung (TW)

(73) Assignee: NATIONAL TAIPEI UNIVERSITY of TECHNOLOGY, Taipei (TW)

( * ) Notice: Subject to any disclaimer, the term of this patent is extended or adjusted under 35 U.S.C. 154(b) by 268 days.

(21) Appl. No.: 14/318,679

(22) Filed: Jun. 29, 2014

(65) Prior Publication Data

US 2015/0377170 A1 Dec. 31, 2015

(51) Int. Cl.

| | |
|---|---|
| ***F02D 41/30*** | (2006.01) |
| ***F02D 41/24*** | (2006.01) |
| ***F02D 41/04*** | (2006.01) |
| *F02D 41/14* | (2006.01) |
| *F02D 41/18* | (2006.01) |

(52) U.S. Cl.

CPC ..... *F02D 41/2477* (2013.01); *F02D 41/047* (2013.01); *F02D 41/1456* (2013.01); *F02D 41/18* (2013.01); *F02D 41/2451* (2013.01); *F02D 2041/1417* (2013.01); *F02D 2200/0614* (2013.01)

(58) Field of Classification Search

CPC ... F02D 41/30; F02D 41/3005; F02D 41/047; F02D 41/2477; F02D 41/18; F02D 41/1456; F02D 2041/1417

See application file for complete search history.

(56) References Cited

U.S. PATENT DOCUMENTS

| | | | | |
|---|---|---|---|---|
| 4,667,640 | A * | 5/1987 | Sekozawa | F02D 41/047 123/480 |
| 4,852,538 | A * | 8/1989 | Nagaishi | F02D 41/107 123/480 |
| 4,953,530 | A * | 9/1990 | Manaka | F02D 41/047 123/399 |
| 5,404,856 | A * | 4/1995 | Servati | F02D 41/047 123/478 |
| 6,856,889 | B2 * | 2/2005 | Nagaishi | F02D 35/025 123/435 |

FOREIGN PATENT DOCUMENTS

| | | | | |
|---|---|---|---|---|
| JP | 61061940 | A * | 3/1986 | F02D 41/06 |

* cited by examiner

*Primary Examiner* — Hieu T Vo
(74) *Attorney, Agent, or Firm* — CKC & Partners Co., Ltd.

(57) ABSTRACT

An air-fuel parameter control system includes an injector, an air-fuel parameter sensor, a fuel film parameter calculation module, an air-fuel parameter prediction module and a fuel injection calibration module. The injector injects fuel into an intake manifold. The air-fuel parameter sensor detects a detected air-fuel parameter in an exhaust pipe. The fuel film parameter calculation module calculates a fuel film parameter relating to a fuel film accumulated the intake manifold based on the detected air-fuel parameter, an amount of the injected fuel and an amount of air flowing into the engine. The air-fuel parameter prediction module predicts a predicted air-fuel parameter based on the detected air-fuel parameter and the fuel film parameter. The fuel injection calibration module calibrates the amount of the injected fuel based on a difference between a reference air-fuel parameter and the predicted air-fuel parameter.

18 Claims, 3 Drawing Sheets

AIR-FUEL PARAMETER CONTROL SYSTEM, METHOD AND CONTROLLER FOR COMPENSATING FUEL FILM DYNAMICS

BACKGROUND

1. Technical Field

Embodiments of the present invention relate to air-fuel control. More particularly, embodiments of the present invention relate to the air-fuel parameter control system, method and controller for compensating fuel film dynamics.

2. Description of Related Art

When a typical spark-ignition engine is operating, the toxic gases, such as CO, HC and $No_x$, are produced. The toxic gases can be converted to non-toxic gases by a three-way catalyst converter. When the air-fuel ratio reaches the stoichiometric air-fuel ratio, the catalyst conversion efficiency can be optimized, which minimizes the toxic gases. As a result, the air-fuel ratio not only affects the engine performance, but also affects the exhaust toxic gases. Therefore, air-fuel ratio control plays an important role in the engine management system.

The air-fuel ratio can be easily controlled to reach the stoichiometric air-fuel ratio when the engine operates in a steady state. However, when operation of the engine varies rapidly, such as quickly opening the throttle, the air-fuel ratio varies severely, which is unfavorable for reaching the stoichiometric air-fuel ratio.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

One aspect of the present invention is to control the air-fuel ratio to reach the stoichiometric air-fuel ratio even if operation of the engine varies rapidly.

In accordance with one embodiment of the present invention, an air-fuel parameter (such as the air-fuel ratio) control system for compensating fuel film dynamics includes an injector, an air-fuel parameter sensor, a fuel film parameter calculation module, an air-fuel parameter prediction module and a fuel injection calibration module. The injector is configured for injecting fuel into an intake manifold of an engine. The air-fuel parameter sensor is configured for detecting a detected air-fuel parameter in an exhaust pipe of the engine. The fuel film parameter calculation module is configured for calculating at least one fuel film parameter relating to a fuel film accumulated on an inner wall of the intake manifold based on the detected air-fuel parameter, an amount of the injected fuel and an amount of air flowing into the engine. The air-fuel parameter prediction module is configured for predicting a predicted air-fuel parameter based on the detected air-fuel parameter and the fuel film parameter. The fuel injection calibration module is configured for calibrating the amount of the injected fuel based on a difference between a reference air-fuel parameter and the predicted air-fuel parameter.

In accordance with another embodiment of the present invention, an air-fuel parameter control method for compensating fuel film dynamics is provided, including the following steps. Fuel is injected into an intake manifold of an engine. A detected air-fuel parameter in an exhaust pipe of the engine is detected. At least one fuel film parameter relating to a fuel film accumulated on an inner wall of the intake manifold is calculated based on the detected air-fuel parameter, an amount of the injected fuel and an amount of air flowing into the engine. A predicted air-fuel parameter is predicted based on the detected air-fuel parameter and the fuel film parameter. The amount of the injected fuel is calibrated based on a difference between a reference air-fuel parameter and the predicted air-fuel parameter.

In accordance with yet another embodiment of the present invention, a controller for compensating fuel film dynamics is provided, which includes a fuel film parameter calculation module, an air-fuel parameter prediction module and a fuel injection calibration module. The fuel film parameter calculation module is configured for calculating at least one fuel film parameter relating to a fuel film accumulated on an inner wall of an intake manifold of an engine based on a detected air-fuel parameter, an amount of an injected fuel injected into the engine and an amount of air flowing into the engine. The air-fuel parameter prediction module is configured for predicting a predicted air-fuel parameter based on the detected air-fuel parameter and the fuel film parameter. The fuel injection calibration module is configured for calibrating the amount of the injected fuel based on a difference between a reference air-fuel parameter and the predicted air-fuel parameter.

In the foregoing embodiments, the air-fuel parameter control system and method takes the fuel film accumulated on the inner wall of the intake manifold into consideration, in which the fuel film may affect the air-fuel parameter in the exhaust pipe when operation of the engine varies rapidly. As a result, even though operation of the engine varies rapidly, the air-fuel ratio in the exhaust pipe can still be controlled to reach the stoichiometric air-fuel ratio.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
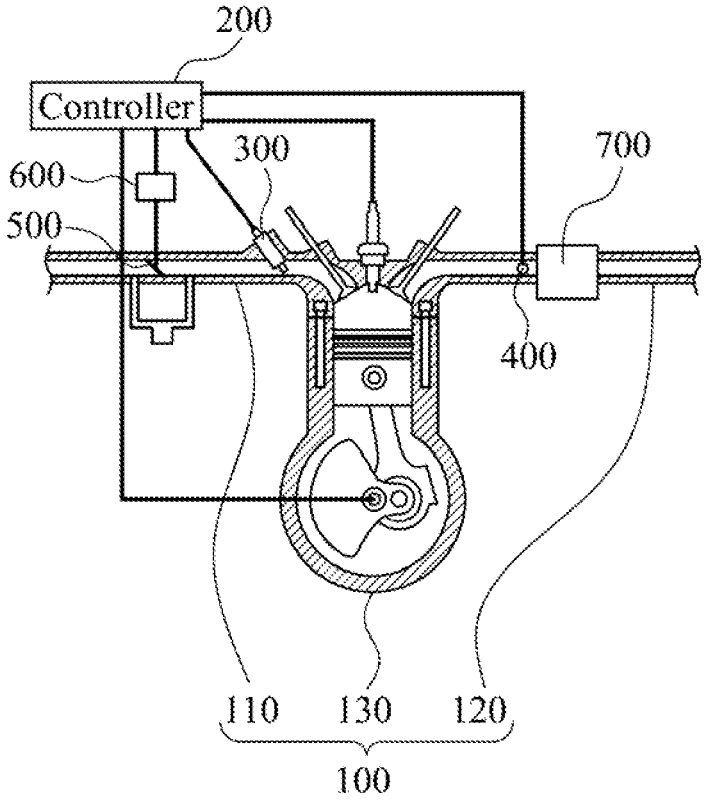
FIG. 1 is a cross-sectional view of an engine in accordance with one embodiment of the present invention.

Reference will now be made in detail to the present embodiments of the invention, examples of which are illustrated in the accompanying drawings. Wherever possible, the same reference numbers are used in the drawings and the description to refer to the same or like parts. In the whole context, the term "air-fuel parameter" means the air-fuel ratio or the fuel-air equivalence ratio.

FIG. 1 is a cross-sectional view of an engine 100 in accordance with one embodiment of the present invention. As shown in FIG. 1, the engine 100 includes an intake manifold 110, an exhaust pipe 120 and a cylinder 130. The intake manifold 110 and the exhaust pipe 120 are fluidly connected to opposite sides of the cylinder 130. An injector 300 is disposed in the intake manifold 110 to inject fuel into the intake manifold 110. A throttle 500 is disposed in the intake manifold 110, and it allows air flowing into the intake manifold 110 and controls the amount of the air flowing into the intake manifold 110 as well. An air amount detector 600 is coupled to the throttle 500 to detect the amount of the air flowing into the intake manifold 110. A three-way catalyst converter 700 is disposed in the exhaust pipe 120 for converting toxic gases to non-toxic gases when the engine 100 is in operation. An air-fuel parameter sensor 400 is disposed in the exhaust pipe 120 to detect a detected air-fuel parameter in the exhaust pipe 120 of the engine 100. The conversion efficiency of the three-catalyst converter 700 can be optimized by controlling the air-fuel ratio in the exhaust pipe 120 to reach the stoichiometric air-fuel ratio. However, the air-fuel ratio cannot be easily controlled when operation of the engine 100 varies rapidly.

Figure 2:
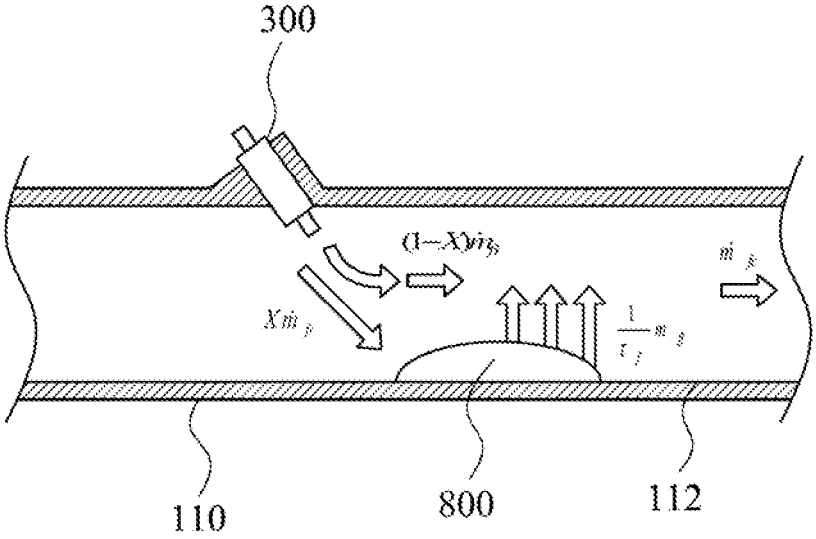
FIG. 2 is an enlarged fragmentary view of the engine in FIG. 1.

In some embodiments of the present invention, it is found that the reason why the air-fuel ratio cannot be easily controlled when operation of the engine 100 varies rapidly is due to the fuel film dynamics in the intake manifold 110. More particularly, reference can be now made to FIG. 2, which is an enlarged fragmentary view of the engine 100 in FIG. 1. As shown in FIG. 2, when the injector 300 injects the fuel into the intake manifold 110, a part of the fuel may be accumulated on an inner wall 112 of the intake manifold 110 to form the fuel film 800. When the engine 100 is in steady operation, the fuel film 800 has a steady thickness, so that the fuel film does not affect the air-fuel ratio significantly. However, when operation of the engine 100 varies rapidly, the fuel film 800 varies severely and does not have a steady thickness. In other words, the fuel film 800 may become thicker or thinner when operation of the engine 100 varies rapidly, which affects the air-fuel ratio, whereby making control for the air-fuel ratio difficult.

Figure 3:
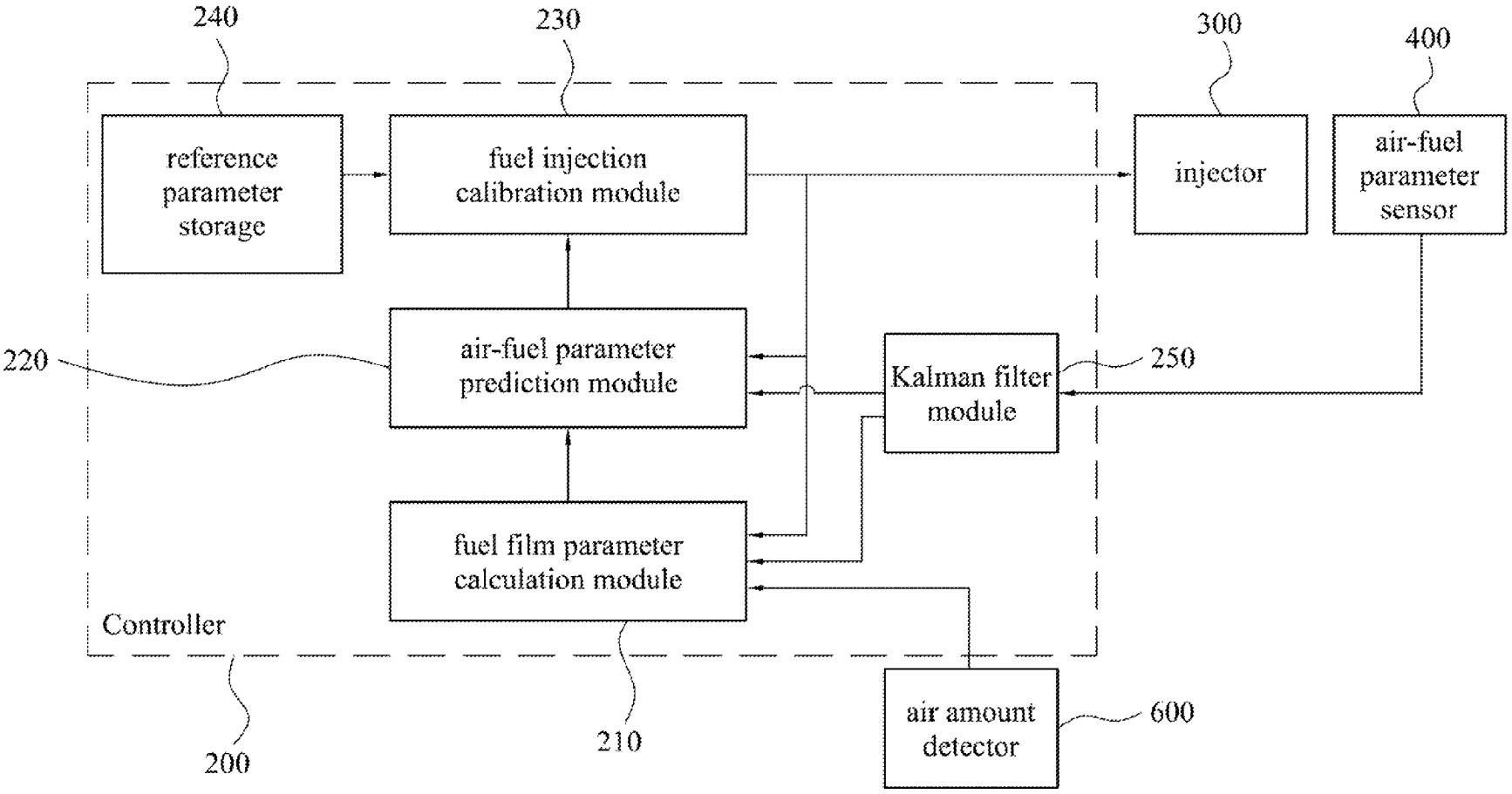
FIG. 3 is a block diagram of the air-fuel parameter control system in accordance with one embodiment of the present invention.

As a result, embodiments of the present invention provide a control system that controls the air-fuel parameter, such as the air-fuel ratio, in consideration of the dynamics of the fuel film 800. Reference can be now made to FIG. 3, which is a block diagram of the air-fuel parameter control system in accordance with one embodiment of the present invention. As shown in FIG. 3, the air-fuel control system includes a controller 200, the injector 300, and an air-fuel parameter sensor 400. The controller 200 includes a fuel film parameter calculation module 210, an air-fuel parameter prediction module 220, a fuel injection calibration module 230 and a reference parameter storage 240. The fuel film parameter calculation module 210 is configured for calculating at least one fuel film parameter relating to the fuel film 800 (See FIG. 2) based on the detected air-fuel parameter detected by the air-fuel parameter sensor 400, an amount of the injected fuel injected by the injector 300 and an amount of air flowing into the engine detected by the air amount detector 600. The air-fuel parameter prediction module 220 is configured for predicting a predicted air-fuel parameter based on the detected air-fuel parameter detected by the air-fuel parameter sensor 400 and the fuel film parameter calculated by the fuel film parameter calculation module 210. The reference parameter storage 240 stores a reference air-fuel parameter. The fuel injection calibration module 230 is configured for calibrating the amount of the injected fuel based on a difference between a reference air-fuel parameter stored in the reference parameter storage 240 and the predicted air-fuel parameter predicted by the air-fuel parameter prediction module 220.

In such a controller 200, because the fuel film parameter relating to the dynamics of the fuel film 800 is taken into consideration, the air-fuel parameter in the exhaust pipe 120 can be controlled to reach the reference air-fuel parameter even if operation of the engine 100 varies rapidly. For example, the air-fuel parameter can be the air-fuel ratio, and the controller 200 can control the air-fuel ratio in the exhaust pipe 120 to reach the stoichiometric air-fuel ratio even if operation of the engine 100 varies rapidly.

Fuel Film Parameter Calculation

In some embodiments, the fuel film parameter calculation module 210 is configured for calculating the fuel film parameter that includes a fuel accumulation ratio X and a time constant of fuel film evaporation $\tau_f$. As shown in FIG. 2, the fuel accumulation ratio X is a ratio of an amount of a part of the injected fuel that is accumulated on the inner wall 112 of the intake manifold 110 to an amount of the injected fuel. The time constant of fuel film evaporation $\tau_f$ relates to an evaporation speed of the fuel film 800. By the fuel accumulation ratio X and the time constant of fuel film evaporation $\tau_f$, the air-fuel parameter prediction module 220 can predict the predicted air-fuel parameter in consideration of the fuel film dynamics.

A sampling period of the fuel film parameter calculation module 210 is equal to a period of an engine cycle $T_s$. In other words, the controller 200 utilizes an event-based structure to describe operation of the engine 100. Regarding description of operation of the engine 100, the event-based structure is more accurate than the time-based structure when operation of the engine 100 varies rapidly. In the event-based structure, the period of the engine cycle $T_s$ substantially satisfies:

$$T_s = 120/n_{cyl}N \quad \text{(Eq. 1)},$$

where $n_{cyl}$ is a number of at least one cylinder 130 of the engine 100, and N is a rotation speed of the engine 100. The fuel film parameter calculation module 210 calculates the fuel accumulation ratio X and the time constant of fuel film evaporation $\tau_f$ by an auto-regressive moving average (ARMA) model and a recursive least square (RLS) model. The detailed calculation of the fuel film parameter calculation module 210 is described as follows.

The dynamics of the fuel film 800 is shown in FIG. 2. $m_{ff}$ is the amount of the fuel film 800, especially the mass of the fuel film 800. $\dot{m}_{fc}$ is the flow rate of the fuel flowing into the cylinder 130 (See FIG. 1), especially the fuel mass flow rate. The mass dynamics of the fuel film 800 substantially satisfies:

$$\dot{m}_{ff} = X\dot{m}_{fi} - \frac{1}{\tau_f}m_{ff}. \quad \text{(Eq. 2)}$$

The fuel mass flow rate of the fuel flowing into the cylinder 130 substantially satisfies:

$$\dot{m}_{fc} = (1 - X)\dot{m}_{fi} + \frac{1}{\tau_f}m_{ff}. \quad \text{(Eq. 3)}$$

The Laplace transfer function for Eq. 2 and Eq. 3 can be obtained, and then, a difference equation with emulation discretization is shown:

$$m_{fc}(k) - m_{fi}(k) = \left(1 - \frac{T_s}{\tau_f}\right)[m_{fc}(k-1) - m_{fi}(k-1)] + X[m_{fi}(k-1) - m_{fi}(k)]. \quad \text{(Eq. 4)}$$

A difference equation shown below describes the relation between the air-fuel ratio in the cylinder 130 (See FIG. 1) and the air-fuel ratio in the exhaust pipe 120 after an engine cycle.

$$AFR_{cyl}(k-1) = AFR_{exh}(k) \quad \text{(Eq. 5)},$$

in which $AFR_{cyl}(k-1)$ is the air-fuel ratio during the intake stroke at "k" moment, and $AFR_{exh}(k)$ is the air-fuel ratio during the exhaust stroke at "k+1" moment. It is noted that in this context, the time interval between the "k" moment and the "k+1" moment is the period of the engine cycle $T_s$, so as to implement the event-based structure.

Next, the dynamic response between the actual air-fuel ratio and the detected air-fuel ratio detected by the air-fuel parameter sensor 400 are considered, and the transfer function in z-domain is shown:

$$G(z) = \frac{AFR_m(z)}{AFR_{exh}(z)} = \frac{\frac{T_s}{\tau_\lambda}}{z - 1 + \frac{T_s}{\tau_\lambda}}, \quad \text{(Eq. 6)}$$

in which $AFR_m$ is the detected air-fuel ratio detected by the air-fuel parameter sensor 400, and $\tau_\lambda$ is the response time constant of the air-fuel parameter sensor 400.

Eq. 6 can be transferred into a difference equation, and Eq. 5 can be involved to the difference equation transferred from Eq. 6, so as to get the following equation:

$$AFR_{cyl}(k-2) = \frac{AFR_m(k) - \left(1 - \frac{T_s}{\tau_\lambda}\right)AFR_m(k-1)}{\frac{T_s}{\tau_\lambda}}. \quad \text{(Eq. 7)}$$

The fuel mass flow rate of the flue getting into the cylinder 130 can be expressed as:

$$m_{fc}(k-2) = \frac{m_{ac}(k-2)}{AFR_{cyl}(k-2)}, \quad \text{(Eq. 8)}$$

in which $m_{ac}$ is the amount of air flowing into the engine 100, especially the air mass of air flowing into the engine per engine cycle. In some embodiments, $m_{ac}$ can be detected by the air amount detector 600.

After combining Eq. 8 and Eq. 4, functions Y(k) and U(k) can be set as:

$$Y(k) = \frac{\frac{T_s}{\tau_\lambda} m_{ac}(k-2)}{AFR_m(k) - \left(1 - \frac{T_s}{\tau_\lambda}\right)AFR_m(k-1)} - m_{fi}(k-2); \quad \text{(Eq. 9)}$$

$$U(k) = m_{fi}(k-3) - m_{fi}(k-2), \quad \text{(Eq. 10)}$$

and the following equation can be obtained:

$$Y(k) = \left(1 - \frac{T_s}{\tau_f}\right)Y(k-1) + XU(k). \quad \text{(Eq. 11)}$$

The ARMA model can be utilized to rewrite Eq. 11 as:

$$Y(k) = \phi^T(k)\theta(k) \quad \text{(Eq. 12)},$$

in which $\phi(k)^T = [Y(k-1)\ U(k)]$ are known, and $\theta(k) = [a\ b]^T$ are the parameters to be determined. The RLS model can be utilized to identify the parameters a and b, in which $$a = 1 - \frac{T_s}{\tau_f},\ b = X.$$

After recalculation the equations:

$$a = 1 - \frac{T_s}{\tau_f},\ b = X,$$

the fuel accumulation ratio X and the time constant of fuel film evaporation $\tau_f$ can be obtained. In the foregoing calculation, the amount of air flowing into the engine $m_{ac}$, the detected air-fuel ratio $AFR_m$ and the amount of the injected fuel $m_{fi}$ are utilized to obtain the fuel accumulation ratio X and the time constant of fuel film evaporation $\tau_f$.

Air-Fuel Parameter Prediction

In some embodiments, the air-fuel parameter prediction module 220 and the fuel injection calibration module 230 can be performed by a model predictive controller. The air-fuel parameter prediction is described as follows. The air-fuel ratio of the engine 100 is represented as the fuel-air equivalence ratio as shown the following equation:

$$x(k+1) = Ax(k) + B\Delta u(k)$$

$$y(k) = Cx(k) \quad \text{(Eq. 13)},$$

in which A is the system matrix that satisfies:

$$A = \begin{bmatrix} \frac{-T_s}{\tau_f} & 0 & 0 \\ \frac{14.7}{m_{ac}} & 0 & 0 \\ 0 & 1 + \frac{T_s}{\tau_\lambda} & \frac{-T_s}{\tau_\lambda} \end{bmatrix},$$

and B is the input matrix that satisfies:

$$B = \begin{bmatrix} X\left(1 + \frac{T_s}{\tau_f}\right) \\ \frac{14.7(1-X)}{m_{ac}} \\ 0 \end{bmatrix},$$

and C is the output matrix that satisfies C=[0 0 1], and x is the system state vector that satisfies $x = [m_{ff}\ \phi_e\ \phi_m]^T$. $\phi_e$ is the fuel-air equivalence ratio in the exhaust pipe 120. $\#_m$ is the fuel-air equivalence ratio measured or detected by the air-fuel parameter sensor 400. Δu is the system input that satisfies $\Delta u = m_{fc}$, and y is the system output that satisfies $y = \phi_m$. The fuel accumulation ratio X, the period of the engine cycle $T_s$, and the amount of air flowing into the engine $m_{ac}$ are described in the foregoing "Fuel film parameter calculation", so they are not described repeatedly herein.

Eq. 13 can be transferred by generalized predictive control (GPC) into the following equation:

$$\hat{y}(k+j|k) = CA^{j}E[x(k)] + \sum_{i=0}^{j-1} CA^{j-i-1}B\Delta u(k+i), \quad \text{(Eq. 14)}$$

in which j is the sampling number, and Eq. 14 can be transferred to the following equation when the sampling number "j" is 5:

$$\begin{bmatrix} \hat{y}(k+1|k) \\ \hat{y}(k+2|k) \\ \hat{y}(k+3|k) \\ \hat{y}(k+4|k) \\ \hat{y}(k+5|k) \end{bmatrix} = \begin{bmatrix} CA \\ CA^2 \\ CA^3 \\ CA^4 \\ CA^5 \end{bmatrix} \begin{bmatrix} \hat{x}_1(k) \\ \hat{x}_2(k) \\ \hat{x}3(k) \end{bmatrix} + \quad \text{(Eq. 15)}$$

$$\begin{bmatrix} CB & 0 & 0 & 0 & 0 \\ CAB & CB & 0 & 0 & 0 \\ CA^2B & CAB & CB & 0 & 0 \\ CA^3B & CA^2B & CAB & CB & 0 \\ CA^4B & CA^3B & CA^2B & CAB & CB \end{bmatrix} \begin{bmatrix} \Delta u(k) \\ \Delta u(k+1) \\ \Delta u(k+2) \\ \Delta u(k+3) \\ \Delta u(k+4) \end{bmatrix},$$

in which $\hat{y}(k+1|k)$ is the predicted system output (including the predicted air-fuel parameter) at the "k+1" moment which is calculated based on the detected air-fuel parameter and the fuel film parameter obtained at the "k" moment, and $\hat{y}(k+2|k)$ is the predicted system output at the "k+2" moment which is calculated based on the detected air-fuel parameter and the fuel film parameter obtained at the "k" moment, and so forth.

As a result, the air-fuel parameter prediction module 220 is operable to predict the predicted air-fuel parameter at the "k+j" moment represented by $\hat{y}(k+j|k)$ based on the detected air-fuel parameter x(k) and the fuel film parameters (including the fuel accumulation ratio X and the time constant of fuel film evaporation $\tau_f$) obtained at the "k" moment.

Fuel Injection Calibration

In some embodiments, the fuel injection calibration module 230 and the air-fuel parameter prediction module 220 can be performed by the model predictive controller (MPC), and the fuel injection calibration is described as follows.

Eq. 15 can be rewritten as:

$$y_{N12} = F_{N12}\hat{x}(k) + H_{N123}u_{N3} \quad \text{(Eq. 16).}$$

The optimized cost function for the Eq. 16 can be expressed as:

$$J = (H_{123}u_{N3} + F_{N12}\hat{x}(k) - w)^T \overline{R}(H_{123}u_{N3} + F_{N12}\hat{x}(k) - w)_n_{N3}{}^T\overline{Q}u_{N3} \quad \text{(Eq. 17),}$$

in which w is the reference trajectory of the reference fuel-air equivalence ratio (i.e., the reference air-fuel parameter), and it satisfies $$w = \begin{bmatrix} 1 \\ 1 \\ 1 \\ 1 \\ 1 \end{bmatrix};$$

$\overline{Q}$ is the diagonal matrix that satisfies $\overline{Q}=1.5$, and it is used to control the error tolerance between the predicted air-fuel parameter and the reference air-fuel parameter; $\overline{R}$ is the diagonal matrix that satisfies $$\overline{R} = \begin{bmatrix} 10 & 0 & 0 & 0 & 0 \\ 0 & 8 & 0 & 0 & 0 \\ 0 & 0 & 5.5 & 0 & 0 \\ 0 & 0 & 0 & 2.1 & 0 \\ 0 & 0 & 0 & 0 & 1 \end{bmatrix},$$

and it can be adjusted based on the performance of the hardware of the controller 200.

By partially differentiating Eq. 17, the optimized u can be obtained as:

$$u = ((H_{N123}{}^T\overline{R}H_{N123}) + \overline{Q})^{-1}H_{123}{}^T\overline{R}(w - F_{N12}\hat{x}(k)) \quad \text{(Eq. 18).}$$

Based on Eq. 18, the system input "u" that represents fuel mass flowing into the cylinder 130 $m_{fc}$ can be optimized to make the air-fuel parameter in the exhaust pipe 120 to reach the reference air-fuel parameter. As a result, the fuel injection calibration module 230 can calibrate the amount of the injected fuel according the optimized $m_{fc}$ that is obtained based on a difference between the reference air-fuel parameter w and the predicted air-fuel parameter represented by $\hat{y}(k+j|k)$, so as to control the air-fuel parameter in the exhaust pipe 120 to reach the reference air-fuel parameter.

Kalman Filter

In some embodiments, when the air-fuel parameter sensor 400 is a narrow-band oxygen sensor, it may not provide a precise system state vector $x=[m_{ff}\ \phi_c\ \phi_m]^T$. As a result, as shown in FIG. 3, in some embodiments, the controller 200 further includes a Kalman filter module 250 for providing a precise system state vector $x=[m_{ff}\ \phi_e\ \phi_m]^T$. In other words, the Kalman filter module 250 is configured for estimating an estimated wide-band air-fuel parameter based on the detected air-fuel parameter detected by the air-fuel parameter sensor 400, so that the air-fuel parameter prediction module 220 can predict the predicted air-fuel parameter based on the estimated wide-band air-fuel parameter and the fuel film parameter.

The estimation model of the Kalman filter module 250 can be expressed as:

$$x_{k+1} = A_k\hat{x}_k + B_ku_k + \Gamma\xi_k$$

$$\hat{y}_k = C_k\hat{x}_k + v_k \quad \text{(Eq. 19),}$$

in which $\hat{x}$ is the estimated system vector that satisfies $\hat{x}=[\hat{m}_{ff}\ \hat{\phi}_e\ \hat{\phi}_m]^T$. $\hat{y}$ is the estimated fuel-air equivalence ratio, i.e. the estimated wide-band air-fuel parameter, which satisfies $\hat{y}=\hat{\phi}_m$. u is $m_{fc}$. $A_k$, $B_k$, and $C_k$ are the system matrices in Eq. 13 at the "k" moment. Γ is the system disturbance matrix. ξ is the ambient disturbance input. v is the noise of the air-fuel parameter sensor 400.

When designing the Kalman filter, the discrete system may be verified whether it is fully observable or not with an observability matrix. After confirming the system is fully observable, the discrete Kalman filter can be designed, and the closed-loop estimator is expressed as the following equation:

$$\hat{x}_{k|k}=A_{k-1}\hat{x}_{k-1|k-1}+B_{k-1}u_{k-1}+G_k(y_k-\hat{y}_{k|k-1}) \quad \text{(Eq. 20)},$$

in which G is the Kalman gain and $y_k$ is the detected fuel-air equivalence ratio detected by the air-fuel parameter sensor 400. The algorithm can be separated into time update equations and measurement update equations. The time update equations provide the current state $\hat{x}_{k|k-1}$ and the error covariance $P_{k|k-1}$ to get the priori estimation for the next estimation. Measurement update equations are used for feedback correction. The original estimation and the new measurement state can be used to estimate more realistic state. As a result, the Kalman filter module 250 can estimate an estimated wide-band air-fuel parameter $\hat{x}_{k|k}$ based on the detected air-fuel parameter $y_k$.

When the air-fuel parameter prediction module 220 performs calculation in Eq. 14, E[x(k)] satisfies E[x(k)]=x̂(k). In other words, E[x(k)] is equal to the estimated wide-band air-fuel parameter estimated by the Kalman filter module 250, so that the air-fuel parameter prediction module 220 can predict the predicted air-fuel parameter based on at least the estimated wide-band air-fuel parameter.

Figure 4:
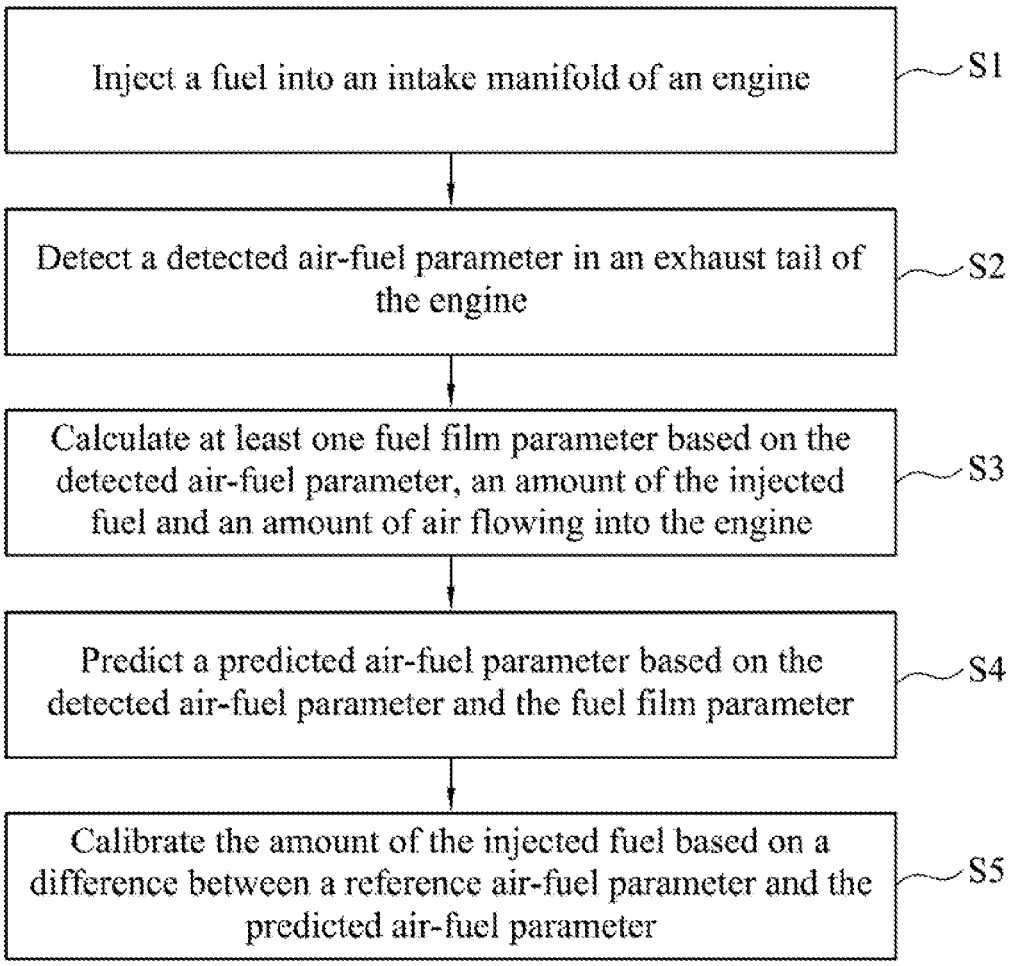
FIG. 4 is a flow chart of the air-fuel parameter control method for compensating fuel film dynamics in accordance with one embodiment of the present invention.

FIG. 4 is a flow chart of the air-fuel parameter control method for compensating fuel film dynamics in accordance with one embodiment of the present invention. As shown in FIG. 4, in step S1, fuel is injected into the intake manifold 110 of the engine 100. In particular, the injector 300 injects the fuel into the intake manifold 110.

In step S2, The detected air-fuel parameter in the exhaust pipe 120 of the engine 100 can be detected. In particular, the air-fuel parameter sensor 400 detects the detected air-fuel parameter in the exhaust pipe 120 of the engine 100.

In step S3, the fuel film parameter relating to the fuel film 800 accumulated on the inner wall 112 of the intake manifold 110 is calculated based on the detected air-fuel parameter, the amount of the injected fuel and the amount of air flowing into the engine. In particular, the fuel film parameter calculation module 210 utilizes the amount of air flowing into the engine $m_{ac}$, the detected air-fuel ratio $AFR_m$ and the amount of the injected fuel $m_{fi}$ to obtain the fuel accumulation ratio X and the time constant of fuel film evaporation $\tau_f$.

In step S4, the predicted air-fuel parameter is predicted based on the detected air-fuel parameter and the fuel film parameter. In particular, the air-fuel parameter prediction module 220 predicts the predicted air-fuel parameter at the "k+j" moment represented by ŷ(k+j|k) based on the detected air-fuel parameter x(k) and the fuel film parameters (including the fuel accumulation ratio X and the time constant of fuel film evaporation $\tau_f$) obtained at the "k" moment.

In step S5, the amount of the injected fuel is calibrated based on a difference between the reference air-fuel parameter and the predicted air-fuel parameter. In particular, the fuel injection calibration module 230 calibrates the amount of the injected fuel based on a difference between the reference air-fuel parameter w and the predicted air-fuel parameter ŷ(k+j|k).

In some embodiments, when the air-fuel parameter sensor 400 is the narrow-band oxygen sensor, the estimated wide-band air-fuel parameter can be estimated based on the detected air-fuel parameter by a Kalman filter method, so that the air-fuel parameter prediction module 220 can predict the predicted air-fuel parameter based on a more precise estimated air-fuel parameter in the exhaust pipe 120.

In the foregoing embodiments, the controller 200 can be, but is not limited to be, implemented by an integrated circuit or a processor installed with corresponding software or firmware that performs the fuel film parameter calculation module 210, the air-fuel parameter prediction module 220, the fuel injection calibration module 230 and the Kalman filter module 250.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An air-fuel parameter control system for compensating fuel film dynamics, comprising:

an injector for injecting fuel into an intake manifold of an engine;

an air-fuel parameter sensor for detecting a detected air-fuel parameter in an exhaust pipe of the engine;

a fuel film parameter calculation module for calculating at least one fuel film parameter relating to a fuel film accumulated on an inner wall of the intake manifold based on the detected air-fuel parameter, an amount of the injected fuel and an amount of air flowing into the engine;

an air-fuel parameter prediction module for predicting a predicted air-fuel parameter based on the detected air-fuel parameter and the fuel film parameter; and a fuel injection calibration module for calibrating the amount of the injected fuel based on a difference between a reference air-fuel parameter and the predicted air-fuel parameter.

2. The air-fuel parameter control system of claim 1, wherein a sampling period of the fuel film parameter calculation module is equal to a period of an engine cycle.

3. The air-fuel parameter control system of claim 2, wherein the period of the engine cycle substantially satisfies:

$$T_s = \frac{120}{n_{cyl}N},$$

wherein $T_s$ is the period of the engine cycle, and $n_{cyl}$ is a number of at least one cylinder of the engine, and N is a rotation speed of the engine.

4. The air-fuel parameter control system of claim 1, wherein the fuel film parameter calculation module is configured for calculating the fuel film parameter that comprises a fuel accumulation ratio and a time constant of fuel film evaporation based on the detected air-fuel parameter, the amount of the injected fuel and the amount of air flowing into the engine, wherein the fuel accumulation ratio is a ratio of an amount of a part of the injected fuel that is accumulated on the inner wall of the intake manifold to an amount of the injected fuel, wherein the time constant of fuel film evaporation relates to an evaporation speed of the fuel film.

5. The air-fuel parameter control system of claim 4, wherein the fuel film parameter calculation module is configured for calculating the fuel accumulation ratio and the time constant of fuel film evaporation by an auto-regressive moving average (ARMA) model and a recursive least square (RLS) model.

6. The air-fuel parameter control system of claim 1, wherein the air-fuel parameter sensor is a narrow-band oxygen sensor, and the air-fuel parameter control system further comprises:

a Kalman filter module for estimating an estimated wide-band air-fuel parameter based on the detected air-fuel parameter, wherein the air-fuel parameter prediction module is configured for predicting the predicted air-fuel parameter based on the estimated wide-band air-fuel parameter and the fuel film parameter.

7. A controller for compensating fuel film dynamics, comprising:

a fuel film parameter calculation module for calculating at least one fuel film parameter relating to a fuel film accumulated on an inner wall of an intake manifold of an engine based on a detected air-fuel parameter, an amount of an injected fuel injected into the engine and an amount of air flowing into the engine;

an air-fuel parameter prediction module for predicting a predicted air-fuel parameter based on the detected air-fuel parameter and the fuel film parameter; and a fuel injection calibration module for calibrating the amount of the injected fuel based on a difference between a reference air-fuel parameter and the predicted air-fuel parameter.

8. The controller of claim 7, wherein a sampling period of the fuel film parameter calculation module is equal to a period of an engine cycle.

9. The controller of claim 8, wherein the period of the engine cycle substantially satisfies:

$$T_s = \frac{120}{n_{cyl}N},$$

wherein $T_s$ is the period of the engine cycle, and $n_{cyl}$ is a number of at least one cylinder of the engine, and N is a rotation speed of the engine.

10. The controller of claim 7, wherein the fuel film parameter calculation module is configured for calculating the fuel film parameter that comprises a fuel accumulation ratio and a time constant of fuel film evaporation based on the detected air-fuel parameter, the amount of the injected fuel and the amount of air flowing into the engine, wherein the fuel accumulation ratio is a ratio of an amount of a part of the injected fuel that is accumulated on the inner wall of the intake manifold to an amount of the injected fuel, wherein the time constant of fuel film evaporation relates to an evaporation speed of the fuel film.

11. The controller of claim 10, wherein the fuel film parameter calculation module is configured for calculating the fuel accumulation ratio and the time constant of fuel film evaporation by an auto-regressive moving average (ARMA) model and a recursive least square (RLS) model.

12. The controller of claim 7, further comprising:

a Kalman filter module for estimating an estimated wide-band air-fuel parameter based on the detected air-fuel parameter, wherein the air-fuel parameter prediction module is configured for predicting the predicted air-fuel parameter based on the estimated wide-band air-fuel parameter and the fuel film parameter.

13. An air-fuel parameter control method for compensating fuel film dynamics, comprising:

(a) injecting fuel into an intake manifold of an engine;

(b) detecting a detected air-fuel parameter in an exhaust pipe of the engine;

(c) calculating at least one fuel film parameter relating to a fuel film accumulated on an inner wall of the intake manifold based on the detected air-fuel parameter, an amount of the injected fuel and an amount of air flowing into the engine;

(d) predicting a predicted air-fuel parameter based on the detected air-fuel parameter and the fuel film parameter; and (e) calibrating the amount of the injected fuel based on a difference between a reference air-fuel parameter and the predicted air-fuel parameter.

14. The air-fuel parameter control method of claim 13, wherein a sampling period of the step (c) is equal to a period of an engine cycle.

15. The air-fuel parameter control method of claim 14, wherein the period of the engine cycle substantially satisfies:

$$T_s = \frac{120}{n_{cyl}N},$$

wherein $T_s$ is the period of the engine cycle, and $n_{cyl}$ is a number of at least one cylinder of the engine, and N is a rotation speed of the engine.

16. The air-fuel parameter control method of claim 13, wherein the step (c) comprises:

calculating a fuel accumulation ratio and a time constant of fuel film evaporation based on the detected air-fuel parameter, the amount of the injected fuel and the amount of air flowing into the engine, wherein the fuel accumulation ratio is a ratio of an amount of a part of the injected fuel that is accumulated on the inner wall of the intake manifold to an amount of the injected fuel, wherein the time constant of fuel film evaporation relates to an evaporation speed of the fuel film.

17. The air-fuel parameter control method of claim 16, wherein the step (c) is performed by an auto-regressive moving average (ARMA) model and a recursive least square (RLS) model.

18. The air-fuel parameter control method of claim 13, further comprising:

estimating an estimated wide-band air-fuel parameter based on the detected air-fuel parameter by a Kalman filter method, wherein the predicted air-fuel parameter is predicted based on the estimated wide-band air-fuel parameter and the fuel film parameter.

* * * * *